United States Patent [19]

Armstead et al.

[11] Patent Number: 4,847,123

[45] Date of Patent: Jul. 11, 1989

[54] POP-UP ARTIFICIAL CHRISTMAS TREE

[76] Inventors: Kenneth W. Armstead, 17556 Greenview, Detroit, Mich. 48219; Terry N. Bezue, 18530 Plainview, Detroit, Mich. 48210; Kienuwa H. Obaseki, 2712 Golfside #105, Ann Arbor, Mich. 48108

[21] Appl. No.: 205,701

[22] Filed: Jun. 13, 1988

[51] Int. Cl.[4] ..... A47G 33/06

[52] U.S. Cl. ..... 428/9; 428/8; 428/20; 211/197

[58] Field of Search ..... 428/7–9, 428/18–21, 35, 99; 135/26; 211/196, 197, 205; 156/61

[56] References Cited

U.S. PATENT DOCUMENTS

| | | | |
|---|---|---|---|
| 3,159,523 | 12/1964 | Abramson | 428/8 |
| 3,801,415 | 4/1974 | Fristot | 428/20 |
| 3,811,991 | 5/1974 | Dieffenbach | 428/20 |
| 3,846,213 | 11/1974 | Thiemann | 428/9 |
| 4,130,678 | 12/1978 | Higgins | 428/9 |
| 4,140,823 | 2/1979 | Weskamp | 428/9 |
| 4,144,364 | 3/1979 | Tice | 428/9 |
| 4,496,615 | 1/1985 | Huang | 428/9 |
| 4,659,597 | 4/1987 | Lau | 428/9 |

FOREIGN PATENT DOCUMENTS

| | | | |
|---|---|---|---|
| 0967465 | 10/1982 | U.S.S.R. | 428/8 |
| 2130881 | 6/1984 | United Kingdom | 428/9 |

*Primary Examiner*—Ellis P. Robinson
*Assistant Examiner*—Archene A. Turner
*Attorney, Agent, or Firm*—Dykema Gossett

[57] ABSTRACT

A pop-up artificial Christmas tree has an elongated trunk which is held vertical by a stand. A plurality of stationary sleeves are affixed to the trunk and a guide sleeve is disposed on the trunk to slide proximate to and remote from an adjacent stationary sleeve. Pivotally connected to depend from each sleeve are a plurality of limbs that bear integrally attached branches. When the guide sleeve is pushed into proximity with the lowermost stationary sleeve, the limbs of the stationary sleeves and the guide sleeves pivot to substantially horizontal orientations. The guide sleeve is held into proximity with the lowermost stationary sleeve by a pin extending through the trunk, and an extension with branches of decreasing length from bottom to top may be attached to extend from the top of the trunk to effect a conical configuration of a natural tree. The pop-up artificial Christmas tree may be collaspsed to a storage state when the guide sleeve is slid away from the lowermost stationary sleeve, the extension taken from the top, and the collapsed tree and extension may be stored in a bag that also serves as an under-the-tree spread. From the storage state, the pop-up artificial Christmas tree may be popped up again to the posture of a natural tree like one might pop up an umbrella.

10 Claims, 3 Drawing Sheets

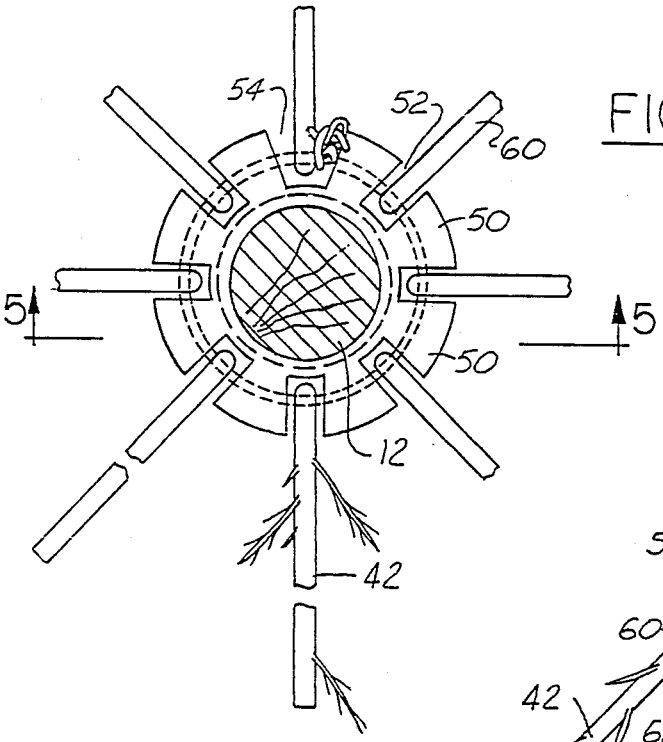
FIG. 4
FIG. 5
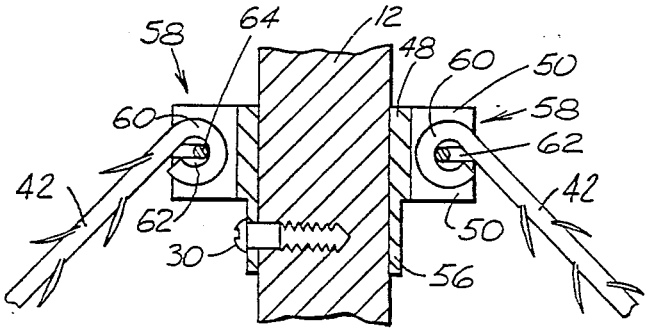
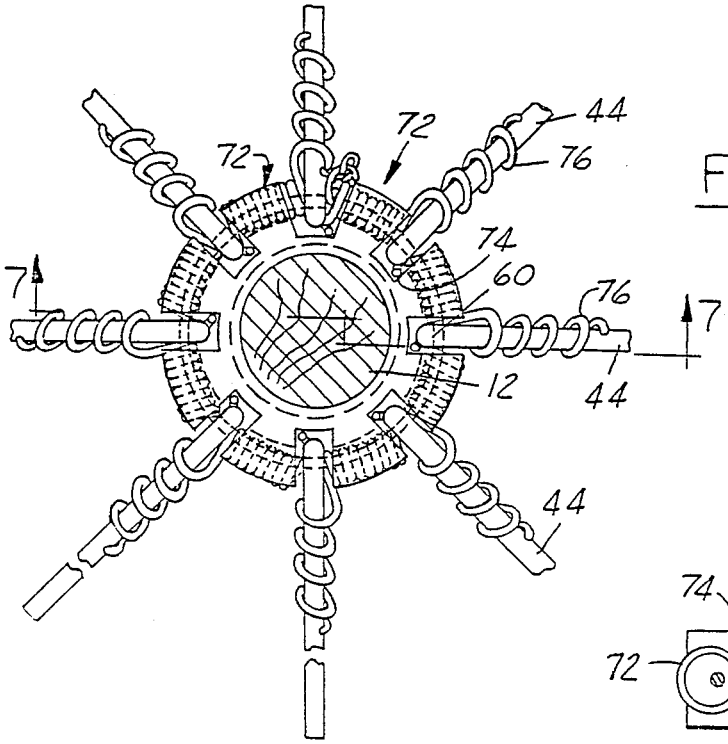
FIG. 6
FIG. 7
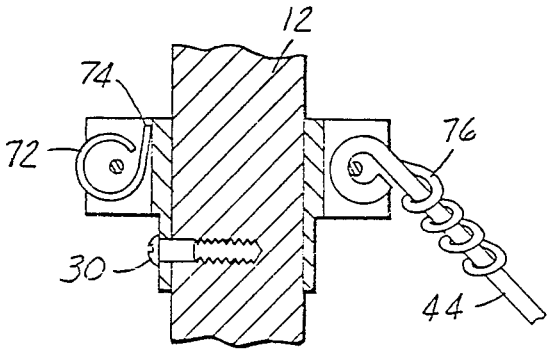

POP-UP ARTIFICIAL CHRISTMAS TREE

FIELD OF THE INVENTION

The present invention relates generally to artificial Christmas trees. More particularly the invention relates to foldable or collapsible artificial evergreen trees that are set up for limited period of the Christman season, during which ornaments and lights are strung upon them and after which the artificial trees are taken down to be stored until subsequent limited periods. Still more particularly, the invention relates to a pop-up artificial Christmas tree that is easily erectable from a compact storage state as opening an umbrella, and generally as easily collapsed to the compact storage state as collapsing an umbrella.

BACKGROUND OF THE INVENTION

Artificial Christmas trees are well-known substitutes for natural trees traditionally used for Christmas celebrations, notwithstanding the warmth, aroma, and structural readiness of the natural tree. Artificial trees have the advantage of being usable over a period of years and thereby eliminate the yearly expense of purchasing real trees for the short holiday seaons. They may be made of synthetic materials that are more fire resistant than the natural trees. They need no watering, and they need less protection than natural trees from bumps and scraps that strip needles from limbs. They may also be fashioned to a "perfect" symmetry.

Even the "advantages" of real evergreen trees are not lost with use of artifical trees. The versatility of modern materials in the texture, color, and shape of evergreen needles bring visual warmth to the artificial product. Sprays from cans,solid and liquid room deodorants, and other such means duplicate the aroma of a real tree. Moreover, many attempts have been made to make artifical Christmas trees that are substantially ready when taken from storage, examples of which can be found in the U.S. Patents discussed hereinafter as "Prior Art".

PRIOR ART

U.S. Pat. No. 4,659,597 issued to Lau discloses an artificial Christmas tree constructed in a manner that it can be transformed between a compact storage state and an erected state. Lau uses a series of limb assemblies spaced vertically upon the trunk of the artificial tree. Each assembly has a lower collar affixed to the trunk and an upper collar slidably disposed on the trunk. Lever arms, including artificial branches, are interconnected in a manner permitting the branches to pivot from an orientation parallel to the trunk outwardly from the trunk to angle upwardly in the orientation of branches on a tree. Lau does not teach using a single mechanism operative from the bottom of the tree to set the branches in the orientation of branches on a tree and, so, considerable time may be spent in orienting the branches to set up the tree in a natural looking state.

U.S. Pat. No. 4,496,615 issued to Huang discloses an artificial plastic tree constructed so that all of its branches can be substantially simultaneously transformed between a storage state and an erected state. Huang also uses a series of branch assemblies that include collars with pivoting branches spaced vertically upon the trunk of the artificial tree. All of the collars of Huang are secured to the trunk, and the branches are free to pivot to a upswept state when the tree is vertically disposed and to a collapsed state when the tree is inverted. The inversion of the tree is accomplished with some significant inconvenience, especially inversion of a relativley large tree. Moreover, the freely pivotal branches may lack stability for supporting certain ornamental tree dressings when the tree is accidentally bumped into, and the appearance of the tree as being real surely would suffer if the branches were spaced to accommodate unimpeded pivoting.

U.S. Pat. No. 4,140,823 issued to Weskamp discloses a foldable Christmas tree and branch holder. As a part of the tree's structure, a plurality of branch holders are constructed in a manner that the branches can be pivoted from a state in which branches are substantially parallel with the tree to a state in which the branches are upswept. The limitations of Weskamp are substantially the limitations associated with either Lau or Huang or both, that is, the branches may be individually oriented or oriented in assemblages or the tree must be inverted and the branches spaced to allow free pivoting.

U.S. Pat. No. 3,846,213 issued to Thiemann discloses a foldable artifical Christmas tree that has a plurality of branches spaced in tiers, with the branches of the lower tiers being longer than the branches of the upper tiers. Each branch of the tier is pivotable upwardly to a disposition that forms an acute angle with the tree, and each branch is supported by a link that is pivotable between the trunk and intermediate points of the branch that the link supports. Thiemann teaches adjusting tiers of branches to produce the natural Christmas tree configuration, but with the particular short coming of requiring that the branches be individually oriented or oriented in the assemblages. At least the latter short coming is characteristic each time the tree is erected.

OBJECTS OF THE INVENTION

Accordingly, it is one object of the present invention to provide a pop-up artificial Christmas tree that has branches which may substantially all be collapsed simultaneously and which may substantially all be erected simultaneously, so that the artificial Christmas tree may be set up and taken down quickly and conveniently.

Another object of the invention is to provide a pop-up artificial Christmas tree that has limbs or branches that may substantially all be oriented simultaneously to provide a natural appearance.

Yet another object of the invention is to provide a pop-up artificial Christmas tree which has an erection mechanism suitable for erecting a large artificial Christmas tree, so that there is not a requirement that the tree be inverted to bring its limbs or branches into a natural orientation.

Still yet another object of the present invention is to provide a pop-up artificial tree which has a single mechanism operative from the bottom of the tree to set the limbs or branches in a natural orientation of limbs or branches of a tree.

Moreover, another object of the present invention is to provide a pop-up artificial tree which has structurally stable limbs, most of which may be simultaneously set up in the natural orientation of limbs on the tree and simultaneously collapsed for storage.

Still yet another object of the invention is to provide an artificial Christmas tree with limbs that may be "popped" up from a collapsed, storage state into a full and natural looking Christmas tree, which can be just as easily collapsed from its popped-up state to a storage state.

A related object of the present invention is to provide accessories for use with a dressed Christmas tree which may be used to store a pop-up artificial Christmas tree in a collapsed state, so that the accessories would not require their own storage space even while they are readily available for use.

SUMMARY OF INVENTION

These and other objects are accomplished in the present invention by a pop-up artificial Christmas tree that has an elongated trunk and a trunk extension from which limbs may extend to support branches in a posture of a natural evergreen tree. The trunk without the extension is to be oriented during normal use so that it may be said to have a top, a top portion, and a bottom portion. The top has a socket in it. The bottom portion has an aperture that extends through the trunk. A stand, which preferably has at least three legs, is attached to the bottom portion of the trunk by a bracket. Each of the legs of the stand is pivotal from a storage posture that is substantially parallel to the trunk, to a posture in which the legs extend outwardly from the trunk at an angle. Free ends of the legs may be placed on a supporting surface so that, in the latter posture, the legs support the trunk to stabilize it in a substantially vertical orientation with the top being upwardly from the bottom.

Each of a plurality of stationary sleeves is affixed to the trunk so that each sleeve is vertically above or below another when the trunk is vertically oriented. Included in the plurality of stationary sleeves is a principal stationary sleeve which is the bottommost stationary sleeve affixed to the vertically oriented trunk. A guide sleeve is disposed upon the vertically oriented trunk below the principal stationary sleeve. The guide sleeve is capable of sliding between positions proximate to and remote from the principal stationary sleeve.

Each stationary sleeve has pivotally connected to it a plurality of stationary sleeve limbs. Each plurality of stationary sleeve limbs substantially surrounds the trunk. Accordingly, a plurality of principal stationary sleeve limbs is pivotally attached to the principal stationary sleeve.

Each stationary sleeve limb has a pivot end and a free end. The pivot end is attached to the stationary sleeve, so that each stationary sleeve limb can pivot between an erected posture and a collapsed posture. In the erected posture, each stationary sleeve limb depends from the stationary sleeve in a substantially horizontally orientation with respect to the vertical trunk. More specifically, each stationary sleeve limb depends from the stationary sleeve in a radial direction that is downward to the free end. In the collapsed posture the stationary sleeve limb is in substantial parallel juxtaposition to the trunk. Each stationary sleeve limb of one plurality of stationary sleeve limbs is in vertical alignment with a stationary sleeve limb of at least one other plurality of stationary sleeve limbs, in an alignment that includes a principal stationary sleeve limb.

A plurality of guide sleeve limbs, each of which is pivotally connected to the guide sleeve, also substantially surrounds the trunk. Each guide sleeve limb has a pivot end and an upper extremity. The pivot end is attached to the guide sleeve. This structure is analogous to the structure of the stationary sleeve and its limbs, so that accordingly, each guide sleeve limb is pivotal between a erected posture and a collapsed posture. However, each guide sleeve limb, when in the erected posture that is substantially horizontal to the vertical oriented trunk, extends from the trunk radially and upwardly. When in the collapsed posture the guide sleeve limb extneds upwardly in substantial parallel juxtaposition to the trunk.

A plurality of vertical connecting branches each extend substantially parallel to the trunk. Each vertical branch is pivotally connected to a principal stationary sleeve limb and at least one stationary sleeve limb aligned with that principal stationary sleeve limb. The vertical branches are also pivotally connected to a guide sleeve limb that is in alignment with the principal stationary sleeve limb. Such connecting structures substantially surround the tree.

The pop-up artificial Christmas tree may be popped-up to an erected posture when the guide sleeve is pushed upwardly into proximity with the principal stationary sleeve while the tree trunk is vertically oriented. This causes the guide sleeve limbs to push stationary sleeve limbs upwardly and outwardly and causes the vertical branches to push other stationary sleeve limbs upwardly and outwardly. Upswept branches on the stationary sleeve limbs effect an appearance of a natural evergreen tree.

A hold pin is provided to be inserted through the aperture in the bottom portion of the trunk to secure the guide sleeve in a position of proximity with the principal stationary sleeve. The trunk extension insertable in the socket of the trunk top has a plurality of limbs and branches topping off the tree in a natural appearance.

The pop-up artifical Christmas tree may be put in a collapsed storage state by sliding the guide sleeve into a position that is remote from the principal stationary sleeve. This causes guide sleeve limbs to pull upon principal stationary sleeve limbs and vertical branches, which in turn pull upon other stationary sleeve limbs, to collapse all of the limbs into substantially parallel juxtaposition to the trunk.

When the pop-up artifical Christmas tree is put in the collapsed storage state, the extension, which is taken out of the socket, may be stored beside the trunk. The tree and the detached parts may be wrapped up in a cover that may also be used for spreading beneath the tree over the stand to further dress the tree.

BRIEF DESCRIPTION OF THE DRAWINGS

FIG. 4 is a cross-sectional view taken through the trunk in that direction of arrows 4—4 in FIG. 1.

FIG. 5 is a cross-sectional view taken in the direction of arrows 5—5 of FIG. 4.

FIG. 6 is a cross-sectional view taken through the trunk in the direction of arrows 6—6 of FIG. 1.

FIG. 7 is a cross-sectional view taken in the direction of arrows 7-7 of FIG. 6.

DETAILED DESCRIPTION OF THE PREFERRED EMBODIMENT

Figure 1:
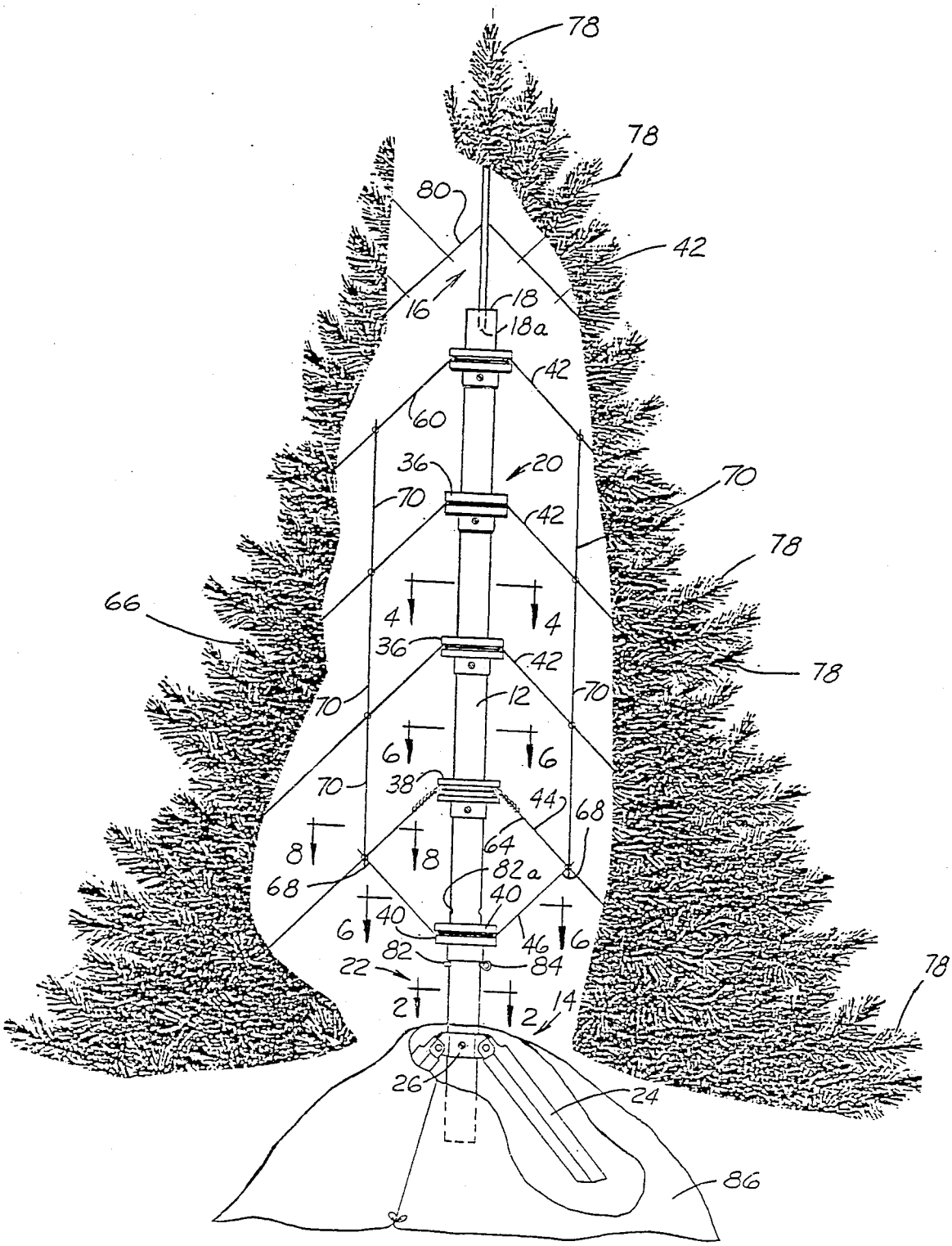
FIG. 1 is a partial elevation and partial schematic cut-away of the pop-up artificial Christmas tree that is the present invention.

Referring now to the drawings in detail, a pop-up artificial Christmas tree embodying the present invention is generally designated by the reference numeral 10. Tree 10 comprises a trunk 12, a stand 14, and a fop extension 16. As the tree is normally oriented in use, trunk 12 has a top 18 above a top portion shown generally at 20. The top portion is above a bottom portion shown generally at 22.

Figure 2:
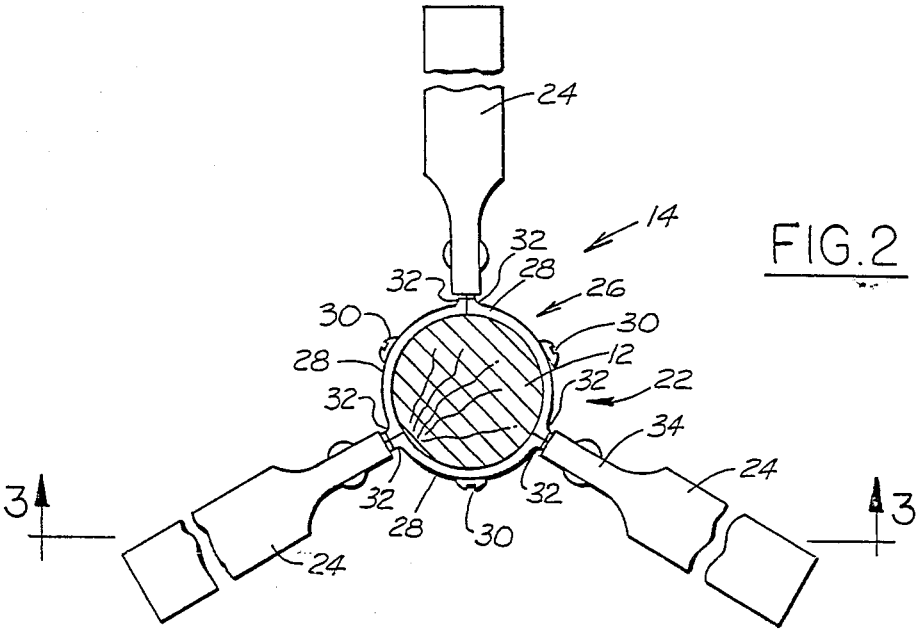
FIG. 2 is a cross-sectional view taken in the direction of arrows 2—2 in FIG. 1, showing the stand for supporting the pop-up artificial Christmas tree in a vertical disposition.
Figure 3:
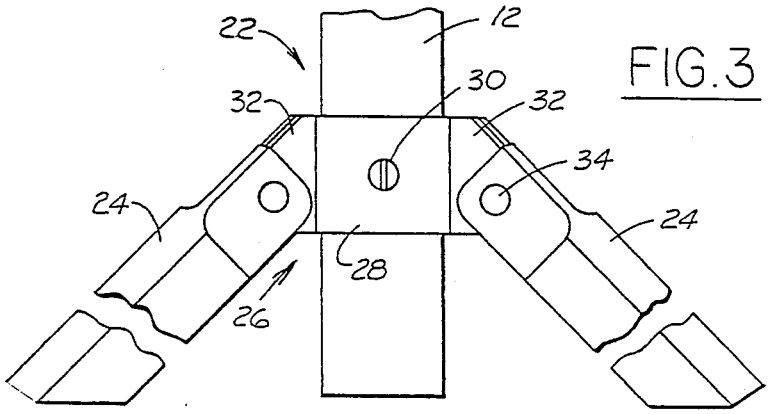
FIG. 3 is a cross-sectional view taken in the direction of arrows 3—3 in FIG. 2.

Stand 14 is attached to the bottom portion 22 of trunk 12. Essentially, stand 14 would be any stand means to hold trunk 12 in a vertical orientation. As shown herein in FIGS. 2 and 3, stand 14 is preferably a tripod structure, having three legs 24 joined by a connecting ring or bracket 26. Connecting ring or bracket 26 has a number of curved plates 28 which are affixed on trunk 12 by screws 30. Each of the curved plates 28 is provided with two flat portions 32 and each riveted on a flat portion 32 of another curved plate 28 as two adjacent curved plates 28 are joined together by means of rivets 34, so as to form bracket 26. On the junction of any two adjacent curved plates 28 is pivoted a leg 24. Preferably the leg 24 is formed of sheet metal stamped out and bended to straddle adjoining flat portions 32 while pivoting about rivets 34. Accordingly, legs 24 pivot inwardly to align parallel with trunk 12 and outwardly to form the tripod structure to hold trunk 12 in a stable vertical orientation.

With particular reference now to FIGS. 1 and 4–7, in accordance with the present invention a plurality of sleeves 36, 38 and 40 of novel design and construction are employed for mounting limbs 42, 44 and 46 on trunk 12. Such a mounting permits movement of limbs 42, 44 and 46 between an outwardly position in which limbs 42, 44 and 46 extend away from trunk 12 generally in the manner of a natural Christmas tree and a position in which the limbs 42-46 are substantially coaxially aligned or aligned in parallel juxtaposition with trunk 12. The latter positioning of the limbs permits easy storage of tree 10 when not in use (FIG. 9).

As presently preferred and shown, sleeves 36, 38 and 40 are all integral structures that include a central tubular member 48 from which top and bottom flanges 50 extend radially intermittently between circumferential intervals 52 and 54. The integral structure also includes a connecting sleeve 56. With regard to each sleeve 36 and 38, a plurality of securing elements such as screws 30 are radially received through the connecting sleeves 56 into trunk 12 to fix sleeves 36 and 38 so that when trunk 12 is vertically oriented sleeves 36 and 38 are positioned at different vertical elevations, in relative positions above or below one another. Accordingly, sleeves 36 and 38 are designated as "stationary sleeves" 36 and 38. Principal stationary sleeve 38, which is shown in FIG. 6, has the general architecture of sleeves 36, but has a dimensional difference so that it can accommodate a spring as will be described and explained later herein. Principal stationary sleeve 38 is positioned so that it is the bottommost of sleeves 36 and 38 when trunk 12 is in the vertical orientation shown in FIG. 1, which is as tree 10 is disposed during normal use. Guide sleeve 40, shown in FIG. 1 below principal stationary sleeve 38, does not have securing elements through its connecting sleeve 56, and so is free to translate coaxially along trunk 12. Because of its position below principal sleeve 38, guide sleeve 40 is translatable toward and away from principal stationary sleeve 38. Each sleeve 36, 38 and 40 may comprise a unitary piece of metal that is constructed by automated metal equipment well-known to those skilled in the art. Alternatively, these parts may be constructed of plastic.

In FIGS. 5 and 7, the loop ends 58 of stationary sleeve limbs 42 and 44 are shown. Not shown in detail are guide sleeve limbs 46, which are constructed the same as stationary sleeve limbs 42 and 44, but for their orientation as shown in FIG. 5 to extend generally upwardly from guide sleeve 40. Stationary sleeve limbs 42 and 44 may be of any suitable type of artificial limb or branch from which extend a multiplicity of artificial needles. Regardless of the method of construction of stationary sleeve limbs 42 and 44, as well as the construction of guide sleeve limb 46, the looped end portion of each limb 42-46 is bent to form a loop 60 that defines a central aperture 62. Loop 60 is disposable within the intervals 52 and 54 of sleeves 36-40 with the central aperture 62 of loop 60 in register with the outer circumference of sleeves 36-40 between the top and bottom flanges 50. When so registered, a suitable securing element, such as a tying wire 64 illustrated in the drawings, could be inserted through the apertures 62 in register between flanges 50. The securing element, wire 64, may be secured to the sleeve 36, 38 and 40 by tying to provide a pivot for limbs 42, 44 and 46. Interval 56 is shown as a wider interval than interval 52, so that space is provided for tying wire 64.

Figure 9:
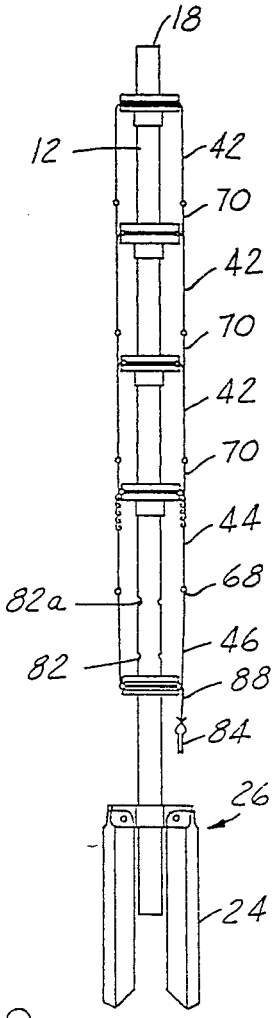
FIG. 9 is a skeletal view of the trunk when the pop-up artificial Christmas tree is in a collapsed posture.

Limbs 42, 44 and 46 being thus secured to sleeves 36, 38 and 40 limbs 42, 44 and 46 are understood to be movable between positions generally approaching the horizontal in which limbs 42, 44 and 46 extend outwardly from trunk 12 as shown in FIG. 1, and positions that are substantially vertical in which limbs 42, 44 and 46 are substantially coaxially aligned or in substantial parallel juxtaposition with trunk 12, as shown in FIG. 9.

More specifically, when stationary sleeve limbs 42 and 44 are positioned substantially horizontally, they are positioned so that they are downwardly angled away from trunk 12 to free ends 66. When guide sleeve limbs 46 are positioned substantially horizontally they are upwardly angled away from trunk 12 to an upper most extremity 68, indicated in FIGS. 1, 8 and 9. Uppermost extremities 68 of guide sleeve limbs 46 are pivotally connected to principal stationary sleeve limbs 44, where guide sleeve limbs 46 are angled upwardly to intersect principal stationary sleeve limbs 44 which are angled downwardly. The point of intersection on each principal stationary sleeve limb 44 is a point intermediate its loop end 58 and its free end 66.

Figure 8:
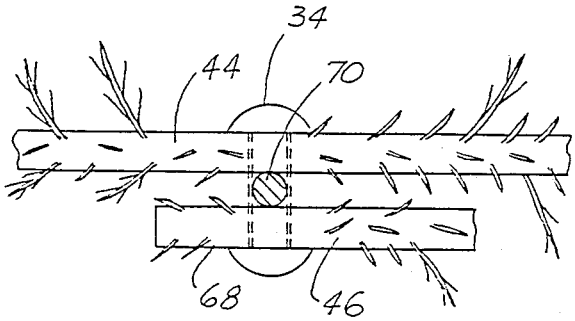
FIG. 8 is a pivotal joint connection view taken in the direction of arrows 8-8 of FIG. 1.

In order for a guide sleeve limb 46 to intersect principal stationary sleeve limb 44, it is preferred that the guide sleeve limb 46 be vertically aligned with the principal stationary sleeve limb 44. Likewise, it is preferred that other stationary sleeve limbs 42 be vertically aligned with the principal stationary sleeve limb 44, so that a vertical connecting branch 70, which is disposed parallel to trunk 12 may be pivotally connected to intermediate points on each stationary sleeve limb 42 in vertical alignment. Each pivotal connection is held together by a rivet 34 in a manner known by those skilled in the art and as shown in FIG. 8.

Thus, when guide sleeve 40 is pushed upwardly on trunk 12 into proximity with principal stationary sleeve 38, the upper extremity 68 of guide sleeve limb 46 pushes upwardly against principal stationary sleeve limb 44 at the point of their pivotal connection. Principal stationary sleeve 38 is fixed on trunk 12 so as to fix the pivotal looped end 58 of principal stationary sleeve limb 44 from translating upwardly on trunk 12. Consequently, principal stationary sleeve limb 44 pivots outwardly to its downwardly angled, substantially horizontal orientation, while guide sleeve limb 46 pivots to its upwardly angled orientation that is also substantially horizontal. At the same time vertical branch 70 transfers the pivoting reaction of principal stationary sleeve limb 44 to the other stationary sleeve limbs 42, so that all of the stationary sleeve limbs 42 and 44 are pivoted to their downwardly angled, substantially horizontal orientations. The assembly just described, of stationary sleeve limb 42, principal stationary sleeve limb 44, guide sleeve limb 44, and vertical branch 70 are uniformly disposed about trunk 12.

As presently preferred and shown in FIG. 6, a plurality of coil springs 72 are seated between flanges 50 of principal stationary sleeve 38. Each spring 72 has one short end portion 74 extended upwardly as it is seated against the central tubular member 48 in an interval 52 or 54 of principal stationary sleeve 38. A long end portion 76 wraps around a principal stationary sleeve limb 44. So disposed, spring 72 mildly resists the upward pivoting of principal stationary sleeve limbs 46 so as to stabilize this structure of the limb assemblies against vibration.

Each limb 42 and 44 has a plurality of auxiliary branches 78 of integral monolithic construction with each limb 42 and 44 and so disposed that when each limb 42 and 44 is in a substantially horizontal orientation, each auxiliary branch 78 angles upwardly in the manner of a real tree. As preferred and shown in FIG. 1, branches 78 that are integrally attached to principal stationary sleeve limb 44 are of a maximum length and branches 78 integral with the other stationary sleeve limbs 42 are of progressively shorter lengths as they are disposed on stationary sleeve limbs 42 approaching the top 18 of trunk 12. When tree 10 is erected, extension 16 is fitted into a socket 18a in the top of trunk 12. Extension 16 has branches 78 extending from extension limbs 80. Thus, when tree 10 is fully erected, it will have a substantially conical configuration to give it a realistic appearance.

At least one aperture 82 extends through trunk 12 in its bottom portion through more apertures **82*a* may extend therethrough. A hold pin 84 is available for inserting through the aperture 82, so as to keep guide sleeve 40 in proximity to principal stationary sleeve 38. Accordingly, tree 10 is held in its erected posture and be made to appear "fuller" or "fatter" when pin 84 is inserted through apertures 82a. When hold pin 84 is removed from aperture 82 or 82*a*, all of the limbs 42, 44 and 46 and branches 72 will be collapsed simultaneously. Extension 16 may be withdrawn from the top 18 of trunk 12 and tree 10, so disassembled and collapsed, may be stored away. A cover or bag 86 is provided for this purpose. Hold pin 84 may be tied to guide sleeve 40 by a string 88 (see FIG. 9), so as not to be lost. Bag 86 may be tied around the collapsed Christmas tree and its disassembled parts. When tree 10 is ready for use again, it may be popped up into an erect state by simply pivoting the legs of stand 14 outwardly to provide a stable base for tree 10, pushing up guide sleeve 40, and inserting hold pin 84 into aperture 82. Bag 86 may then be draped around stand 14, and with extension 16 inserted in top 18 of trunk 12**, the tree is erect and assembled.

Since certain modifications and changes are contemplated as long as such modifications and changes are within the scope of the claims, the above description should be construed as illustrative and not in a limiting sense.

We claim:

1. A pop-up artificial Christmas tree, which may be collapsed into a storage state and erected so that the pop-up artificial Christmas tree is in a natural tree posture, the pop-up artificial Christmas tree comprising:

an elongated trunk having a top portion including a top, and a bottom portion;

stand means attachable to the bottom portion for holding the trunk in a substantially vertical orientation with the top portion being upwardly from the bottom portion;

a plurality of stationary sleeves including a principal stationary sleeve, each stationary sleeve being affixed to the trunk so that, when the trunk is vertically oriented, each stationary sleeve is at a different vertical elevation, the principal stationary sleeve being affixed to a lowermost vertical stationary elevation;

a guide sleeve disposed upon the trunk so that, when the trunk is vertically oriented, the guide sleeve is below the principal stationary sleeve and slidable between positions proximate to and remote from the principal stationary sleeve;

a plurality of stationary sleeve limbs pivotally connected to each stationary sleeve, including a plurality of principal stationary sleeve limbs pivotally connected to the principal stationary sleeve, the plurality of stationary sleeve limbs substantialy surrouding the trunk with each stationary sleeve limb being pivotal outwardly from the trunk to an erected posture and inwardly from the erected posture to a collapsed posture;

a plurality of guide sleeve limbs pivotally connected to the guide sleeve, the pluralty of guide sleeve limbs substantially surrounding the trunk, with each guide sleeve limb being pivotal outwardly from the trunk to an erected posture and inwardly from the erected posture to a collapsed posture, each guide sleeve limb being pivotally connected to a principal stationary sleeve; and a plurality of vertical branches, each vertical branch pivotally connected to at least two vertically aligned stationary branches, including one principal stationary branch, and to the guide sleeve branch pivotally connected to said one stationary sleeve branch, whereby, when the pop-up artificial Christmas tree is in a collapsed storage state wherein the guide sleeve is in a position remote from the principal stationary sleeve and each stationary and guide sleeve branch is in substantial parallel juxtaposition to the trunk, the trunk may be oriented upwardly and the guide sleeve pushed upward into proximity with the principal stationary sleeve, which causes the guide sleeve branches to pivot outwardly from the trunk and force the stationary sleeve branches to also pivot outwardly to effect an appearance of a natural evergreen tree.

2. The pop-up artificial Christmas tree according to claim 1, wherein the stand means is a tripod structure having three legs and a connecting ring, each leg being pivotally connected to the connecting ring and the connecting ring encircling the trunk and affixed thereto.

3. The pop-up artificial Christmas tree according to claim 1, wherein each stationary and guide sleeve comprises a central tubular member surrounding the trunk, top and bottom flanges radially extending intermittently from the central tubular member, and a connecting sleeve axially aligned and attached to the central tubular member, the connecting sleeve being secured to the trunk.

4. The pop-up artificial Christmas tree according to claim 3, wherein each stationary sleeve and each guide sleeve is a unitary construction.

5. The pop-up artificial Christmas tree according to claim 3, wherein an interval is disposed between each two radially extending top flanges most priximate to each other and an interval is disposed between each two radially extending bottom flanges most proximate to each other and wherein each limb has an end portion that is bent to form a loop including a central aperture, said end portion being positioned between top and bottom flanges and within an interval with the central aperture being registered between the flanges and the pop-up artificial Christmas tree further comprising a typing wire inserted through the central aperture, the tying wire being tied to secure all of the limbs pivotally connected to each sleeve.

6. The pop-up artificial Christmas tree according to claim 5, wherein each of the limbs has a plurality of auxiliary branches extending from each limb, each limb and each branch having a multiplicity of artificial needles attached to each said limb and each said branch.

7. The pop-up artificial Christmas tree according to claim 1, wherein the trunk has a socket in the top and wherein the pop-up artificial Christmas tree further comprises a top extension insertable in the socket, whereby, when the top extension is inserted into the socket, the top extension extends therefrom to effect the appearance of a top of a natural evergreen tree.

8. The pop-up artificial Christmas tree according to claim 1, wherein the trunk has at least one aperture extending through the bottom portion and wherein the pop-up artificial Christmas tree further comprises a hold pin insertable in the at least one aperture when the guide sleeve is proximate the principal stationary sleeve and the aperture is below the guide sleeve whereby the guide sleeve rests on the hold pin to keep the tree in a posture in which the tree has the appearance of a natural evergeen tree.

9. The pop-up artificial Christmas tree according to claim 8, wherein means bias the principal stationary sleeve to pivot inwardly.

10. A method of erecting and collapsing a pop-up artificial Christmas tree having a storage bag, an elongated trunk that includes a bottom portion and a top, an extension attachable to the top, an aperture extending through the bottom portion of the trunk, a hold pin insertable through the aperture, erectable stand means affixed to the bottom portion to hold the trunk in a substantially vertical orientation with the top being upwardly from the bottom portion when the stand means is erected, a plurality of stationary sleeves affixed to the trunk, a principal stationary sleeve affixed to the trunk, a guide sleeve slidably disposed upon the trunk between positions proximate to and remote from the principal stationary sleeve, a plurality of stationary sleeve limbs pivotally connected to each stationary sleeve and the principal stationary sleeve, a pivotally of guide sleeve limbs pivotally connected to the guide sleeve, and a plurality of vertical branches, each vertical branch pivotally connected to at least one vertically aligned stationary branch, a principal stationary branch, and a guide sleeve branch, the method comprising the steps of:

removing the tree from a storage bag;
erecting the stand means;
placing the stand means on a substantially horizontal supporting surface;
sliding the guide sleeve upwardly into a proximity of the principal stationary sleeve;
inserting the hold pin into the aperture;
attaching the extension to the top of the tree;
spreading the bag over the stand means;
detaching the extension from the top of the tree;
removing the hold pin from the aperture;
sliding the guide sleeve away from the proximity of the principal stationary sleeve;
removing the bag from over the stand means;
putting the stand means in an erected state;
placing the tree into the bag for storage.

* * * * *